United States Patent [19]

Breimesser et al.

[11] Patent Number: 4,672,591

[45] Date of Patent: Jun. 9, 1987

[54] ULTRASONIC TRANSDUCER

[75] Inventors: Fritz Breimesser, Nürnberg; Günther Gräbner, Heroldsbach; Reinhard Lerch, Erlangen, all of Fed. Rep. of Germany

[73] Assignee: Siemens Aktiengesellschaft, Berlin and Munich, Fed. Rep. of Germany

[21] Appl. No.: 820,208

[22] Filed: Jan. 17, 1986

[30] Foreign Application Priority Data

Jan. 21, 1985 [DE] Fed. Rep. of Germany ..... 3501808

[51] Int. Cl.[4] ..... H04R 17/00

[52] U.S. Cl. ..... 367/152; 367/157; 310/326; 310/334

[58] Field of Search ..... 367/152, 162, 140, 155, 367/157; 310/326, 334, 337

[56] References Cited

U.S. PATENT DOCUMENTS 4,101,795 7/1978 Fukumoto et al. ..... 367/152
4,427,912 1/1984 Bui et al. ..... 310/334

FOREIGN PATENT DOCUMENTS 118837 9/1984 European Pat. Off. .
2914031 5/1980 Fed. Rep. of Germany .
2098828 11/1982 United Kingdom .

OTHER PUBLICATIONS

*Ultrasonics,* "Research and Development", Nov. 1974, p. 235.

"Integrated Silicon–$PV_2$ Acoustic Transducer Arrays," *IEEE Transactions on Electron Devices,* vol. ED-26, No. 12, 1976, pp. 1921–1931.

"The Design of Broad-Band Fluid-Loaded Ultrasonic Transducers," *IEEE Transactions on Sonics and Ultrasonics,* vol. SU 26, No. 6, 1979, pp. 385–393.

"Experimentitle Untersuchungen zum Aufbau von Ultraschallbreitband-wandlern," *Biomedizinische Technik,* vol. 27, No. 7–8, 1982, pp. 182–185.

*Primary Examiner*—Charles T. Jordan
*Assistant Examiner*—John W. Eldred
*Attorney, Agent, or Firm*—Kenyon & Kenyon

[57] ABSTRACT

An ultrasonic transducer comprises a support body, a piezoelectric layer of a material with a relatively high dielectric constant and high acoustic impedance, a first impedance matching layer and a second impedance matching layer (10). The first matching layer consists of silicon.

25 Claims, 8 Drawing Figures

ULTRASONIC TRANSDUCER

BACKGROUND INVENTION

This invention relates to an ultrasonic transducer. More particularly, the invention relates to an ultrasonic transducer comprising a support body, a piezoelectric vibrator arranged on the support body, a first matching layer attached at least indirectly to the piezoelectric vibrator, and a second matching layer attached at least indirectly to a surface of the first matching layer facing away from the piezoelectric vibrator. The piezoelectric vibrator consists of a material having a relatively high dielectric constant and a high acoustic impedance.

Wideband ultrasonic transducers are well known in the fields of ultrasonic medical diagnostics and in the field of non-destructive materials testing. The medical applications, where coupling between body tissue and a sound transducer must be accomplished with a minimum of losses, in particular require improvement of the electromechanical and acoustic properties of ultrasonic transducer systems.

To couple a piezoelectric ultrasonic transducer with an acoustic impedance $Z_0$ of, for example, $29\times10^6$ kg/m$^2$·s wideband to a load such as water which has an acoustic impedance $Z_L$ of about $1.5\times10^6$ kg/m$^2$·s, one or more matching layers can be arranged between the piezoelectric vibrator and the load. In the literature (*IEEE Transactions on Sonics and Ultrasonics,* Vol. Su-26, No. 6, November 1979, pages 385 to 393), the use of so-called quarter wavelength ($\lambda/4$) matching layers is recommended for the design of wideband, low-loss ultrasonic transducers. From theory, equations are obtained for determining the acoustic impedances of the interposed matching layers. If only a single quarter wavelength matching layer is used, the optimum value for its acoustic impedance is given by the equation $Z_1=\sqrt{Z_0\cdot Z_L}$. In an ultrasonic transducer with piezoelectric vibrator consisting of ceramics or lithium niobate ($LiNbO_3$) and with a load of water, an acoustic impedance of about $6.6\times10^6$ kg/m$^2$·s is obtained for the quarter wavelength matching layer. If two quarter wavelength matching layers are arranged between the ultrasonic transducer and the load, the optimum value for the acoustic impedance of the first quarter wavelength matching layer is approximated by the equations $Z_1=\sqrt{Z_0^3\cdot Z_L}$ and the second quarter wavelength matching layer by the equation $Z_2=\sqrt{Z_0\cdot Z_L^3}$. For a piezoelectric vibrator of ceramics or lithium niobate with an acoustic impedance $Z_0$ of $29\times10^6$ kg/m$^2$·s, acting on a load with an acoustic impedance $Z_L$ of $1.5\times10^6$ kg/m$^2$·s, an acoustic impedance $Z_1$ of approximately 13.8 kg/m$^2$·s is obtained for the first quarter wavelength matching layer and an acoustic impedance $Z_2$ of approximately $3.1\times10^6$ kg/m$^2$·s for the second quarter wavelength matching layer. These theoretical values are valid only for a single frequency. It is therefore possible that wideband ultrasonic transducers having layer thicknesses and acoustic impedances which differ slightly from the theoretical values can exhibit good transmission properties. Thus, one can use for the first quarter wavelength matching layer, for example, quartz glass ($Z=13.1\times10^6$ kg/m$^2$·s) and for the second quarter-wavelength matching layer, for example, polymethacrylic acid methyl ester PMMA ($Z=3.2\times10^6$ kg/m$^2$·s).

In a known ultrasonic transducer wherein a ceramic transducer is matched by two quarter wavelength matching layers to a load medium such as body tissue or water, a backing of epoxy resin with an acoustic impedance of approximately $3\times10^6$ kg/m$^2$·s is used. A first quarter wavelength matching layer consists of a glass with an acoustic impedance of approximately $10\times10^6$ kg/m$^2$·s and a second quarter wavelength matching layer consists of polyacryl or of epoxy resin with an acoustic impedance of approximately $3\times10^6$ kg/m$^2$·s. The glass plate, i. e., the first quarter wavelength matching layer, is fastened by a cement adhesive of very low viscosity to the ceramic transducer body. The thickness of the adhesive layer is approximately 2 $\mu$m. The epoxy resin, i.e., the second matching layer, is cast directly on the first matching layer ("Experimental Investigation on the Design of Wideband Ultrasound Transducers", *Biomedizinische Technik,* Vol. 27, Nos. 7 to 8, 1982, pages 182 to 185). This double quarter wavelength matching layer results in an improvement of the bandwidth of the ceramic transmitting layer. The bandwidth of this ultrasonic transducer is approximately 60 to 70% of the center frequency.

In another known ultrasonic transducer which contains a transmitting layer of a material with a relatively high dielectric constant and high acoustic impedance and two quarter wavelength matching layers, the first matching layer, which faces the transmitting layer, has an acoustic impedance of approximately $14\times10^6$ kg/m$^2$·s and consists exemplarily of porcelain, especially a vitreous material (Macor), and preferably of quartz glass (fused silica). The second quarter wavelength matching layer, facing the load, has an acoustic impedance of approximately $4\times10^6$ kg/m$^2$·s and consists exemplarily of polyvinylchloride (PVC) and in particular, of polyvinylidene fluoride (PVDF).

The second matching layer also serves as the receiving layer. In addition, the first matching layer is provided as backing for the receiving layer. By this design an ultrasonic transducer with a low-reflection transmitting layer matched throughout a wide band to a load and a sensitive and wideband receiving layer is obtained. (See European *Offenleounqsschrift* No. 0 118 837.)

In these known ultrasonic transducers, the bandwidth was improved by means of quarter wavelength matching layers, chosen because they had desired acoustic impedance values obtained from theory. It is known from the literature that the number of materials usable as matching layers is limited and that other material properties such as mechanical machinability are relegated to a background role. Such other material properties, however, are important in the design of compact linear or matrix-shaped ultrasonic transducer systems.

An object of the present invention is to provide an improved ultrasonic transducer of the above-described type.

Another, more particular, object of the present invention is to provide such an ultrasonic transducer which has a piezoelectric vibrator matched acoustically throughout a wide band to body tissue or water.

Another particular object of the present invention is to provide such an ultrasonic transducer having a first matching layer which can be machined in a simple manner to give it shape.

SUMMARY OF THE INVENTION

In accordance with the present invention, an ultrasonic transducer comprises a support body, a piezoelectric vibrator body attached to the support body, a first matching layer at least indirectly attached to the vibrator body and a second matching layer at least in directly attached to the first matching layer on a side thereof opposite the vibrator body The vibrator body is made of a material having a high dielectric constant and a high acoustic impedance, while the first matching layer consists of silicon.

Through the choice of silicon as the first matching layer, an ultrasonic transducer in accordance with the invention is matched throughout a wide band to body tissue or water and the manufacture of a linear or matrix-shaped arrangement of several, acoustically substantially decoupled ultrasonic transducers is simplified.

The invention is based on the insight that, if two matching layers are used in a ultrasonic transducer, the acoustic impedance of the first matching layer can exceed substantially the values obtained from the theory, for example, by more than 50%, without considerable reduction of the bandwidth and sensitivity of the transducer.

In accordance with another feature of the present invention, an ultrasonic transducer system comprises a support body and a multiplicity of piezoelectric vibrator bodies attached to the support body. The vibrator bodies are made of a material having a high dielectric constant and a high acoustic impedance. Each of the vibrator bodies is provided with a first matching layer of silicon for performing an impedance matching function. Each of the vibrator bodies is also provided with a second matching layer at least indirectly attached to the first matching layer on a side thereof opposite the respective vibrator body for also performing an impedance matching function. Preferably, the first impedance layer of the vibrator body is a single or a common layer attached at least indirectly to all of the piezoelectric vibrator bodies. Similarly, it is preferable that the second matching layer is constituted by an single or common layer indirectly attached to all of the vibrator bodies via the first matching layer.

In accordance with another feature of the present invention, the multiplicity of piezoelectric vibrator bodies are disposed in a linear arrangement or a rectilinear matrix having a plurality of rows and a plurality of columns. Preferably, the silicon layer is provided on a side facing the vibrator bodies with a plurality of recesses or elongate slots for mechanically decoupling the vibrator bodies from each other. The slots have such a disposition relative to each other that the side of the silicon layer facing the vibrator bodies is divided into a linear arrangement or a matrix-like array of area or plateau sections. These plateau sections are connected by means of an adhesive to the end faces of the piezoelectric vibrator bodies facing away from the common support body. The slots can be formed by means of an etching technique in a multiplicity of different geometrical forms.

Pursuant to another feature of the present invention, electronic components for controlling transmission and reception of ultrasonic pressure waves can be integrated into the first matching layer. Such integration facilitates the construction of a compact linear arrangement or matrix of piezoelectric vibrator bodies in a ultrasonic transducer system.

DETAILED DESCRIPTION

Figure 1:
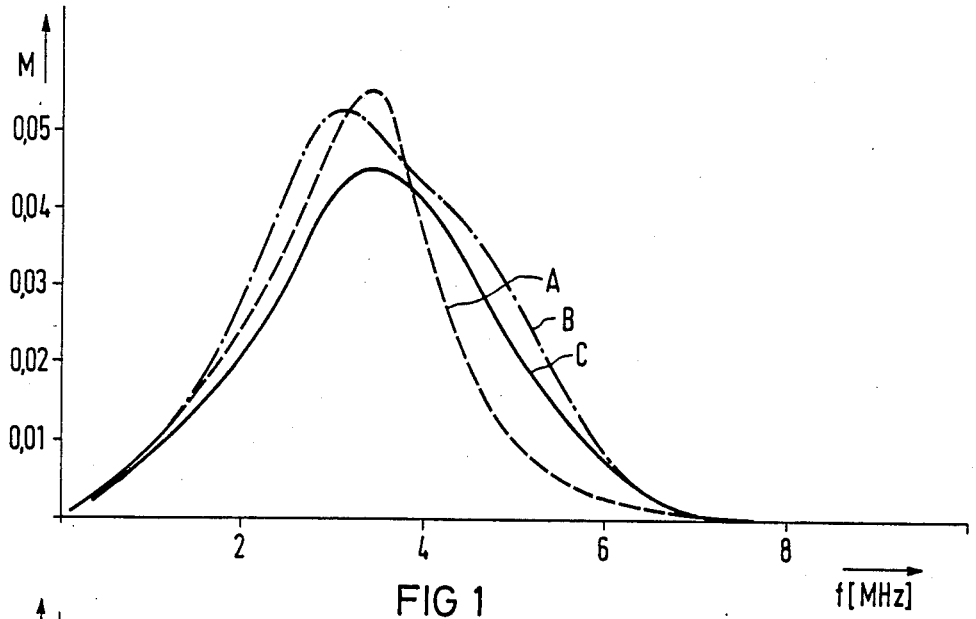
FIGS. 1 and 2 are graphs showing the variation of the product M of the sending and receiving transfer factor of ultrasonic transducers with different matching to a load medium plotted as a function of sound frequency f.

In FIG. 1, the product M of the sending and receiving transfer factor of PZT (lead zirconate titanate) ultrasound transducers ($Z_0=29\times10^6$ kg/m$^2$·s) with different matching to water as the load medium ($Z_L=1.5\times10^6$ kg/m$^2$·s) is shown as a function of sound frequency f. The curve for an ultrasonic transducer with ideal, single-stage quarter wavelength matching ($Z_1=6.6$ kg/m$^2$·s) is designated with reference letter A. The curve B for a respective two stage quarter wavelength ultrasonic transducer, the first quarter wavelength of which has an impedance of $13.8\times10^6$ kg/m$^2$·s corresponds to the ideal, theoretically given value. Curve C belongs to an ultrasonic transducer, the first quarter wavelength layer of which has an acoustic impedance $Z_1$ of $20\times10^6$ kg/m$^2$·s which deviates considerably from the ideal value. Its bandwidth is nearly 60% of the central frequency and is distinctly larger than the bandwidth of the ultrasonic transducer of curve A with only single-stage ideal quarter wavelength matching. In both cases, the second quarter wavelength layer has the acoustic impedance of polyvinylidene flouride ($Z_2=4\times10^6$ kg/m$^2$·s).

On the basis of this insight it is possible to bring to the fore criteria other than acoustic impedance for selecting the materials of the matching layers. One such selection criterion, especially appropriate for the design of linear and matrix-like ultrasonic transducer systems, is the shapability of the material. In this connection, silicon is preferable as the material of the first matching layer, in part because a mature processing technique already exists for silicon. The value of the acoustic impedance of silicon is $19.5\times10^6$ kg/m$^2$·s, which differs substantially from the theoretical ideal value of $13.8\times10^6$ kg/m$^2$·s. For this reason, silicon has never been considered in the technical literature for the first layer of a two-stage match.

Figure 2:
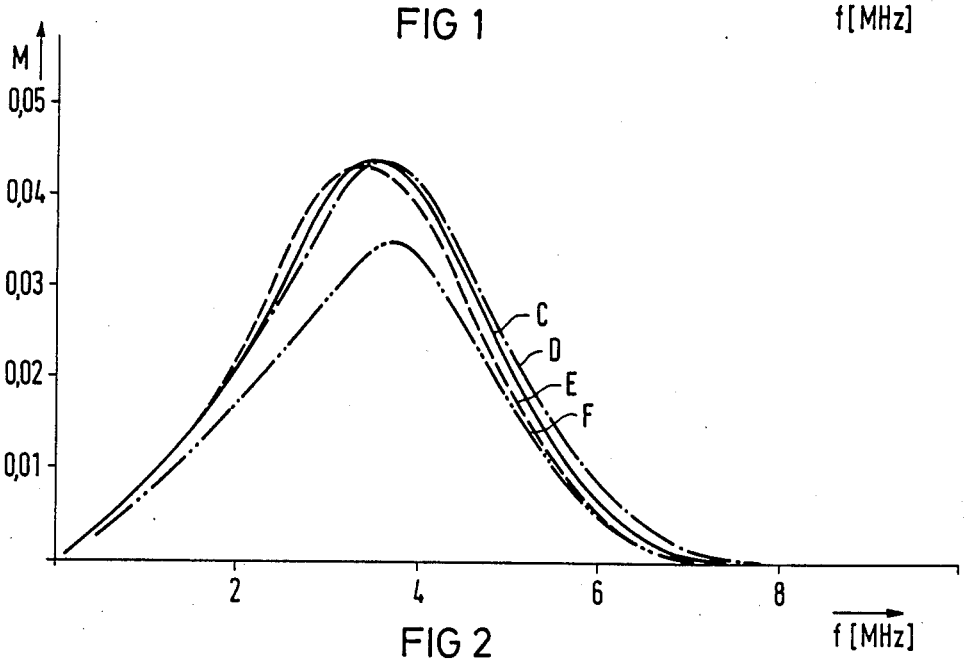

FIG. 2 shows the transfer behavior of ultrasonic transducers having a first matching layer with an acoustic impedance of $20\times10^6$ kg/m$^2$·s and a second matching layer with an acoustic impedance of $4\times10^6$ kg/m$^2$·s. The thickness of the second matching layer is a quarter of the center wavelength ($\lambda/4$). For ultrasonic transducers, in which the thickness of the first matching layer is $1\times\lambda/4$, $0.8\times\lambda/4$, $1.2\times\lambda/4$ and $0.2\times\lambda/4$, respectively, the corresponding curves are designated with reference letters C, D, E and F, respectively. The bandwidth as well as the maximum of the product M of the sending and receiving transfer factor clearly depends only slightly on the first thickness of the first matching layer in a wide range about the ideal quarter wavelength thickness demanded by the theory. Moreover, at a thickness of $0.2\times\lambda/4$, the bandwidth of the ultrasonic transducer is better by about 40% than with an ideal single-stage quarter wavelength matching in accordance with curve A. Owing to this recognition, a wider range of possibilities in the choice of the thickness of the first matching layer is obtained. This is particularly advantageous in view of a possible cross-coupling in a matrix-like or linear arrangement of ultrasonic transducer bodies.

Figure 3:
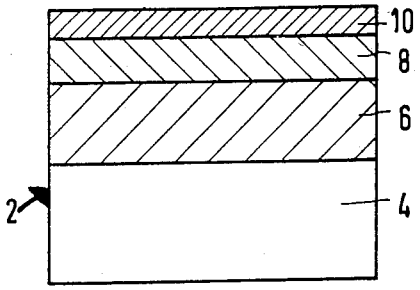
FIG. 3 is a schematic longitudinal section of an ultrasonic transducer in accordance with the invention.

In the embodiment of the invention illustrated in FIG. 3, an ultrasonic transducer 2 comprises a support body 4, a piezoelectric vibrator body 6, a first matching layer 8 and a second matching layer 10. Piezoelectric vibrator body 6 is connected on one side to support body 4 by means of an adhesive over a large area and is attached on an opposite side at least indirectly to first matching layer 8 over a large area, preferably by an adhesive or cement of low viscosity. Vibrator body 6 serves as the transmitting layer and is made of a material with a relatively high dielectric constant and high acoustic impedance, such as a piezoceramic material, preferably lead zirconate titanate (PZT) or lead metaniobate, ($PbNbO_3$).

Second matching layer 10 is disposed between a load (not shown), such as a biological tissue, and first matching layer 8 and is formed from polyvinylchloride (PVC), or polyvinylidene fluoride (PVDF). First matching layer 8 consists of silicon with a high acoustic impedance Z of $19.5\times10^6$ kg/m$^2$·s and is connected to the second matching layer over a large surface, preferably by an adhesive or cement of low viscosity.

Figure 8:
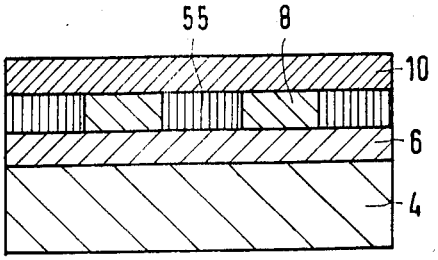
FIGS. 5–8 are schematic longitudinal sections of ultrasonic transducer systems in matrix form in accordance with the present invention.

Matching layer 10 preferably serves also as a sound wave receiving layer. In this case, the polyvinylidene fluoride layer is polarized and provided with electric terminals (not shown). As illustrated in FIG. 8, electronic components 55 for transmitting and receiving ultrasonic signals can be integrated into matching layer 8. Moreover, support body 4 may likewise consist at least partially of silicon. Support body 4 can also contain, in this case, electronic components for transmitting and possibly for receiving ultrasonic signals.

Figure 4:
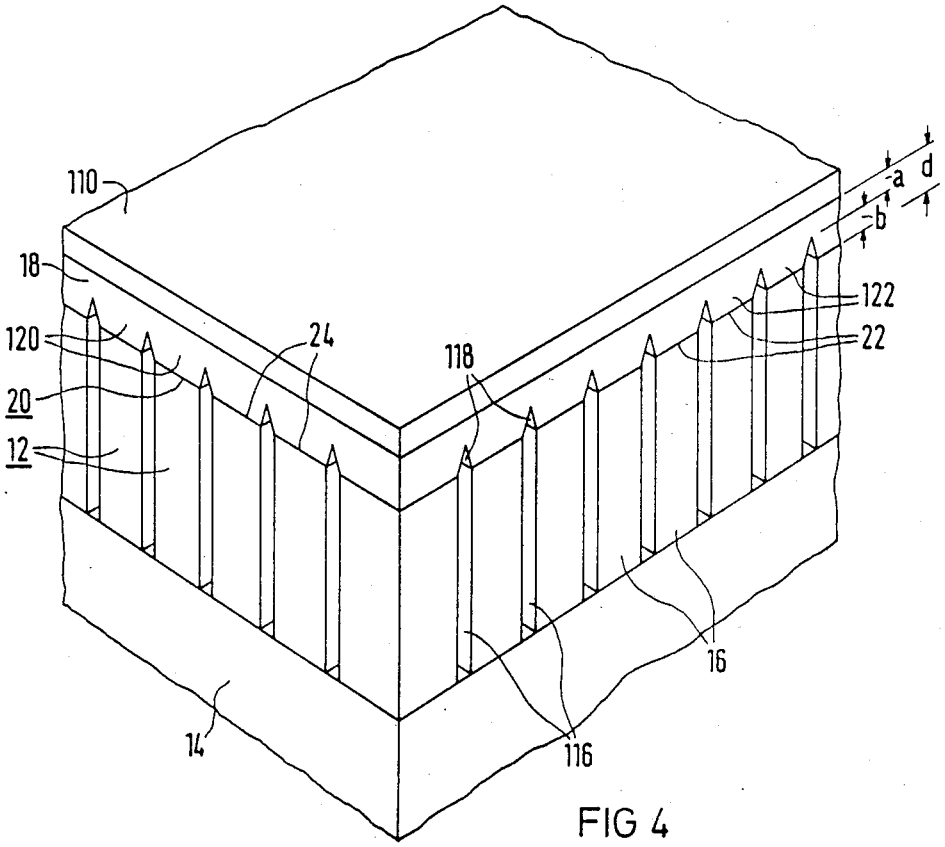
FIG. 4 is a perspective view of an ultrasonic transducer system incorporating a matrix of piezoelectric vibrator bodies in accordance with the present invention.

As shown in FIG. 4, several ultrasonic transducers 12 can be arranged on a common support body 14 in rows 120 and columns 122, to form an ultrasonic transducer system. A first matching layer 18 of each ultrasonic transducer body 12 is formed by a common silicon layer having a large area and provided on its upper planar side with second matching layer 110 in the form of a polyvinylidene fluoride (PVDF) foil having a large area. Matching layer 18 is provided with straight recesses or slots 118 which extend into matching layer 18 from a planar surface 20 facing the piezoelectric vibrator 16. As shown in FIG. 4, slots 118 have V-shaped or triangular cross-sections and divide surface 20 of matching layer 18 into a matrix of area or plateau sections 22. Column-shaped piezoelectric vibrator bodies 16 are separated mechanically from each other by separating gaps 116 which can contain air or a material providing a high mechanical damping effect.

Triangular slots 118 are made preferably by means of an anisotropic etching solution. Planar surface 20 of matching layer 18, at which slots 118 are formed photolithographically, is a (100)-plane of the silicon layer and the side walls of the V-shaped slots 118 each consist of a (111)-plane of the silicon layer. The etching process accordingly comes to a standstill automatically. By this design of an ultrasound transducer system, almost any desired size of the matrix arrangement can be realized with high resolution. In addition, mechanical cross-coupling is reduced by forming slots 118 in matching layer 18, inasmuch as only a fraction of the thickness d of the matching layer is still present as a continuous silicon layer. Th depth b of V-shaped slots 118 is limited by the width of their openings. Plateau sections 22 and end faces 24 of piezoelectric vibrator bodies 16, facing away from support body 14, preferably have at least approximately the same size so that coupling of the piezoelectric vibrator bodies to first matching layer 18 is obtained with losses as low as possible.

The spacing of the piezoelectric vibrator bodies 16 from each other is preferably small so that the proportion of piezo-active transducer surface is maximized. When separating gap 116 has a width of, for example, 70 μm, slots 118 have a maximum depth b of approximately 50 μm. The thickness of silicon layer 18 is approximately 500 μm at a sound frequency of 4 MHz, so that in this case the portion a of the silicon layer not interrupted by slots has a thickness of about 450 μm. This portion a is preferably limited to a small value so as to minimize mechanical cross-coupling effects. The thickness d of the silicon layer 18 can be reduced for this purpose to a fraction of the quarter wavelength value, for example, to 100 μm, where, corresponding to FIGS. 1 and 2, the bandwidth of this ultrasonic transducer according to the curve in FIG. 2, is still larger than the bandwidth of an ultrasonic transducer with an ideal single-stage quarter wavelength match according to curve A in FIG. 1.

Figure 5:
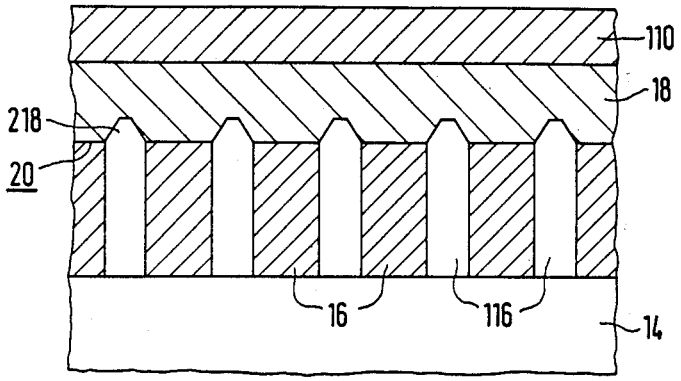

As illustrated in FIG. 5, a linear or matrix-shaped ultrasonic transducer system in accordance with the invention may have the first matching layer 18 provided with slots 218 having trapezoidal cross-sections. These trapezoidal slots 218 are also preferably made by photolithography and an anisotropic etching solution, the etching process being terminated when the desired depth of the slot is reached.

Figure 6:
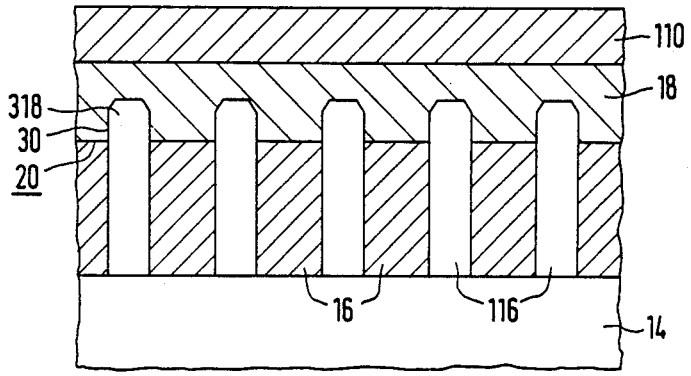
Figure 7:
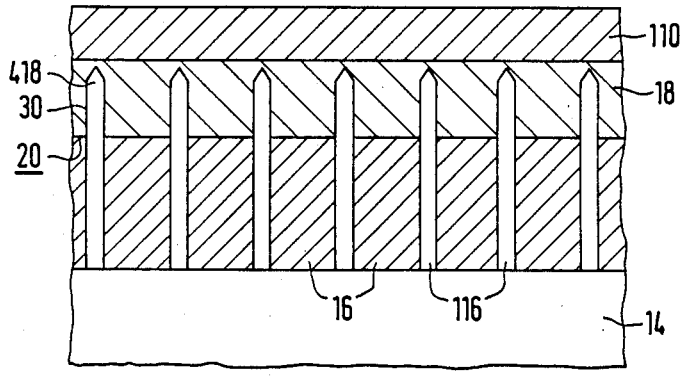

As shown in FIGS. 6 and 7, the first matching layer 18 may be provided with approximately U-shaped slots 318 and 418 having first portions, facing the piezoelectric vibrator bodies and the support body, with rectangular cross-sections and second portions, facing the second matching layer, with triangular or trapezoidal cross-sections. Side walls 30 of slots 318 and 418 which are contiguous with flat side 20 extend perpendicularly thereto. The slot shapes of FIGS. 6 and 7 are likewise manufactured by photolithography and an anisotropic etching solution, provided that planar surface 20 is formed by a (110)-plane of the silicon layer. Slots 318 (FIG. 6), which end in a trapezoidal form, are produced if the etching process is terminated prior to completion. Deep slots 418 with V-shaped tips (FIG. 7) are produced if the etching process is continued until it comes to a standstill by itself. In this particularly advantageous embodiment, the quarter wavelength thickness of the portion a not interrupted by slots can be designed, in a silicon layer 18, to have very low values of approximately 10 to 20 μm.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the descriptions and illustrations herein are proffered to facilitate comprehension of the invention and should not be construed to limit the scope thereof.

What is claimed is:

1. An ultrasonic transducer comprising:

a support body;

a piezoelectric vibrator body attached to said support body, said vibrator body being made of a material having a high dielectric constant and a high acoustic impedance;

a first matching layer at least indirectly attached to said vibrator body, said first matching layer consisting of silicon; and a second matching layer at least indirectly attached to said first matching layer on a side thereof opposite said vibrator body;

said first and second matching layers being provided for acoustic matching of said piezoelectric vibrator to a medium contacting said second layer, said medium being selected from a group consisting of water and body tissue.

2. An ultrasonic transducer according to claim 1 wherein said first matching layer is a quarter wavelength matching layer.

3. An ultrasonic transducer according to claim 1 wherein said second matching layer is a quarter wavelength matching layer.

4. An ultrasonic transducer according to claim 1 wherein said piezoelectric vibrator body is a transmitter and said second matching layer is a receiver consisting of polyvinylidene fluoride.

5. An ultrasonic transducer according to claim 1 wherein said support body consists at least partially of silicon.

6. An ultrasonic transducer system according to claim 5, further comprising electronic components for transmitting and receiving ultrasonic pressure waves, said electronic components being integrated into said support body.

7. An ultrasonic transducer system according to claim 1, further comprising electronic components for transmitting and receiving ultrasonic pressure waves, said electronic components being integrated into said first matching layer.

8. An ultrasonic transducer system according to claim 1, further comprising electronic components for transmitting and receiving ultrasonic pressure waves, said electronic components being integrated into said support body.

9. An ultrasonic transducer system comprising:

a support body;

a multiplicity of piezoelectric vibrator bodies attached to said support body, said vibrator bodies being made of a material having a high dielectric constant and a high acoustic impedance;

first means at least indirectly attached to said vibrator bodies for performing an impedance matching function, said first means including at least one layer of silicon; and second means at least indirectly attached to said first means on a side thereof opposite said vibrator bodies for also performing an impedance matching function.

10. An ultrasonic transducer system according to claim 9 wherein said vibrator bodies are arranged in a rectilinear matrix having a plurality of rows and a plurality of columns.

11. An ultrasonic transducer system according to claim 10 wherein said first means comprises a common silicon layer attached to each of said vibrator bodies.

12. An ultrasonic transducer system according to claim 11 wherein said second means comprises a common polyvinylidene fluoride layer attached to each of said vibrator bodies via said common silicon layer.

13. An ultrasonic transducer system according to claim 11 wherein said common silicon layer has a side facing said vibrator bodies and is provided on said side with means in the form of recesses for mechanically decoupling said vibrator bodies from each other.

14. An ultrasonic transducer system according to claim 13 wherein said recesses are in the form of elongate slots.

15. An ultrasonic transducer system according to claim 14 wherein said slots have a triangular cross-section.

16. An ultrasonic transducer system according to claim 14 wherein said slots have a trapezoidal cross-section.

17. An ultrasonic transducer system according to claim 14 wherein each of said slots has an outer portion facing said vibrator bodies and an inner portion facing said second means, said outer portion having a rectangular cross-section and said inner portion having a trapezoidal cross-section.

18. An ultrasonic transducer system according to claim 14 wherein each of said slots has an outer portion facing said vibrator bodies and an inner portion facing said second means, said outer portion having a rectangular cross-section and said inner portion having a triangular cross-section.

19. An ultrasonic transducer system according to claim 14, further comprising electronic components for transmitting and receiving ultrasonic pressure waves, said electronic components being integrated into said common silicon layer.

20. An ultrasonic transducer according to claim 12 wherein said common polyvinylidene fluoride layer is a quarter wavelength matching layer.

21. An ultrasonic transducer according to claim 11 wherein said common silicon layer is a quarter wavelength matching layer.

22. An ultrasonic transducer system according to claim 10, further comprising electronic components for transmitting and receiving ultrasonic pressure waves, said electronic components being integrated into said support body.

23. An ultrasonic transducer system according to claim 9, further comprising electronic components for transmitting and receiving ultrasonic pressure waves, said electronic components being integrated into said support body.

24. An ultrasonic transducer according to claim 9 wherein said piezoelectric vibrator bodies are transmitters and said second means is a receiver consisting of a layer of polyvinylidene fluoride.

25. An ultrasonic transducer according to claim 9 wherein said support body consists at least partially of silicon.

* * * * *